US006880462B2

(12) United States Patent
Marincic et al.

(10) Patent No.: US 6,880,462 B2
(45) Date of Patent: Apr. 19, 2005

(54) APPARATUS AND METHOD FOR PEELING A PRINTING PLATE FROM A STACK OF PLATES

(75) Inventors: Thomas Marincic, Tyngsboro, MA (US); Aron Mirmelshteyn, Marblehead, MA (US); Joseph Lyons, Wilmington, MA (US)

(73) Assignee: Agfa Corporation, Wilmington, MA (US)

( * ) Notice: Subject to any disclaimer, the term of this patent is extended or adjusted under 35 U.S.C. 154(b) by 0 days.

(21) Appl. No.: 10/039,901

(22) Filed: Jan. 3, 2002

(65) Prior Publication Data

US 2003/0121438 A1 Jul. 3, 2003

(51) Int. Cl.[7] ..... B41L 47/14; B65H 5/08

(52) U.S. Cl. ..... 101/477; 101/479; 101/483; 271/105; 414/796.6; 414/797.2

(58) Field of Search ..... 101/477, 409, 101/479, 480, 483, 389.1; 271/106, 105; 414/796.6, 797.2

(56) References Cited

U.S. PATENT DOCUMENTS

| | | | | |
|---|---|---|---|---|
| 3,625,377 A | * | 12/1971 | Bohannon et al. | 414/796.7 |
| 3,912,253 A | * | 10/1975 | Jarman | 271/5 |
| 4,127,262 A | | 11/1978 | Eberle et al. | |
| 4,311,304 A | * | 1/1982 | Hamada et al. | 271/13 |
| 4,815,723 A | * | 3/1989 | Iizuka | 271/14 |
| 5,443,006 A | * | 8/1995 | Beisel et al. | 101/477 |
| 5,545,001 A | | 8/1996 | Capdeboscq | |
| 5,785,309 A | | 7/1998 | Halup et al. | |
| 5,809,360 A | | 9/1998 | Blake et al. | |
| 5,820,334 A | | 10/1998 | Darcy et al. | |
| 6,113,346 A | | 9/2000 | Blake et al. | |
| 6,164,204 A | * | 12/2000 | Kawada et al. | 101/415.1 |
| 6,176,484 B1 | | 1/2001 | Greive et al. | |
| 6,244,586 B1 | | 6/2001 | Gauger et al. | |

FOREIGN PATENT DOCUMENTS

| | | |
|---|---|---|
| GB | 375260 A | 6/1932 |
| JP | 63106245 | 5/1988 |

* cited by examiner

*Primary Examiner*—Leslie J. Evanisko
(74) *Attorney, Agent, or Firm*—John A. Merecki; Robert A. Sabourin; Joseph D. King

(57) ABSTRACT

An apparatus and method for supporting and feeding printing plates in an imaging system. The apparatus includes a vacuum system for picking up an edge of a top printing plate from a stack of printing plates, and a peeling system including a pair of rotatable belts, a plurality of plate feed beams attached to, and extending between, the pair of rotatable belts, and a drive system for rotating the pair of rotatable belts to displace the plurality of plate feed beams between the top printing plate and an underlying printing plate in the stack of printing plates, thereby peeling the top printing plate from the stack of printing plates.

47 Claims, 16 Drawing Sheets

APPARATUS AND METHOD FOR PEELING A PRINTING PLATE FROM A STACK OF PLATES

FIELD OF THE INVENTION

The present invention is in the field of imaging systems. More particularly, the present invention provides an apparatus and method for supporting and feeding printing plates in an imaging system.

BACKGROUND OF THE INVENTION

In external drum imaging systems, a movable optical carriage is commonly used to displace an image exposing or recording source in a slow scan direction while a cylindrical drum supporting recording media on an external surface thereof is rotated with respect to the image exposing source. The drum rotation causes the recording media to advance past the exposing source along a direction which is substantially perpendicular to the slow scan direction. The recording media is therefore advanced past the exposing source by the rotating drum in a fast scan direction.

An image exposing source may include an optical system for scanning one or more exposing or recording beams. Each recording beam may be separately modulated according to a digital information signal representing data corresponding to the image to be recorded.

The recording media to be imaged by an external drum imaging system is commonly supplied in discrete, flexible sheets and may comprise a plurality of plates, hereinafter collectively referred to as "plates" or "printing plates." Each printing plate may comprise one or more layers supported by a support substrate, which for many printing plates is a plano-graphic aluminum sheet. Other layers may include one or more image recording (i.e., "imageable") layers such as a photosensitive, radiation sensitive, or thermally sensitive layer, or other chemically or physically alterable layers. Printing plates which are supported by a polyester support are also known and can be used in the present invention. Printing plates are available in a wide variety of sizes, typically ranging, e.g., from 9"×12", or smaller, to 58"×80", or larger.

A cassette is often used to supply a plurality of unexposed printing plates to an external drum imaging system. The printing plates are normally supplied in stacks of ten to one hundred, depending upon plate thickness, and are stored in a cassette. Interleaf sheets, commonly referred to as "slip sheets," may be positioned between the printing plates to protect the emulsion side of the printing plates, which is extremely vulnerable to physical damage, such as scratches, which could render a printing plate unusable for subsequent printing. When interleaf sheets are not used, great care must be taken to avoid emulsion damage as each printing plate is separated from the stack, fed from the cassette into the external drum imaging system, and mounted onto the external drum. Unfortunately, preventing such damage as the printing plates are unloaded and fed from a cassette to an external drum has proven to be a very difficult and expensive task in currently available external drum imaging systems, especially when larger (e.g., 45" wide) printing plates are used.

SUMMARY OF THE INVENTION

The present invention provides an apparatus and method for supporting and feeding printing plates in an imaging system.

Generally, the present invention provides an apparatus, comprising:

a stack of printing plates;

a vacuum system for picking up an edge of a top printing plate from the stack of printing plates; and a peeling system including a pair of rotatable belts, a plurality of plate feed beams attached to, and extending between, the pair of rotatable belts, and a drive system for rotating the pair of rotatable belts to displace the plurality of plate feed beams between the top printing plate and an underlying printing plate in the stack of printing plates, thereby peeling the top printing plate from the stack of printing plates.

The present invention additionally provides a method, comprising:

providing a stack of printing plates;

picking up an edge of a top printing plate from the stack of printing plates; and peeling the top printing plate from the stack of printing plates using a peeling system including a pair of rotatable belts, a plurality of plate feed beams attached to, and extending between, the pair of rotatable belts, and a drive system for rotating the pair of rotatable belts to displace the plurality of plate feed beams between the top printing plate and an underlying printing plate in the stack of printing plates.

The present invention also provides an apparatus, comprising:

a cassette containing a stack of printing plates and a peeling system, wherein the peeling system is configured to peel the top printing plate from an underlying printing plate of the stack of printing plates without contacting the underlying printing plate.

BRIEF DESCRIPTION OF THE DRAWINGS

The features of the present invention will best be understood from a detailed description of the invention and embodiments thereof selected for the purpose of illustration and shown in the accompanying drawings in which.

DETAILED DESCRIPTION OF THE INVENTION

Figure 1:
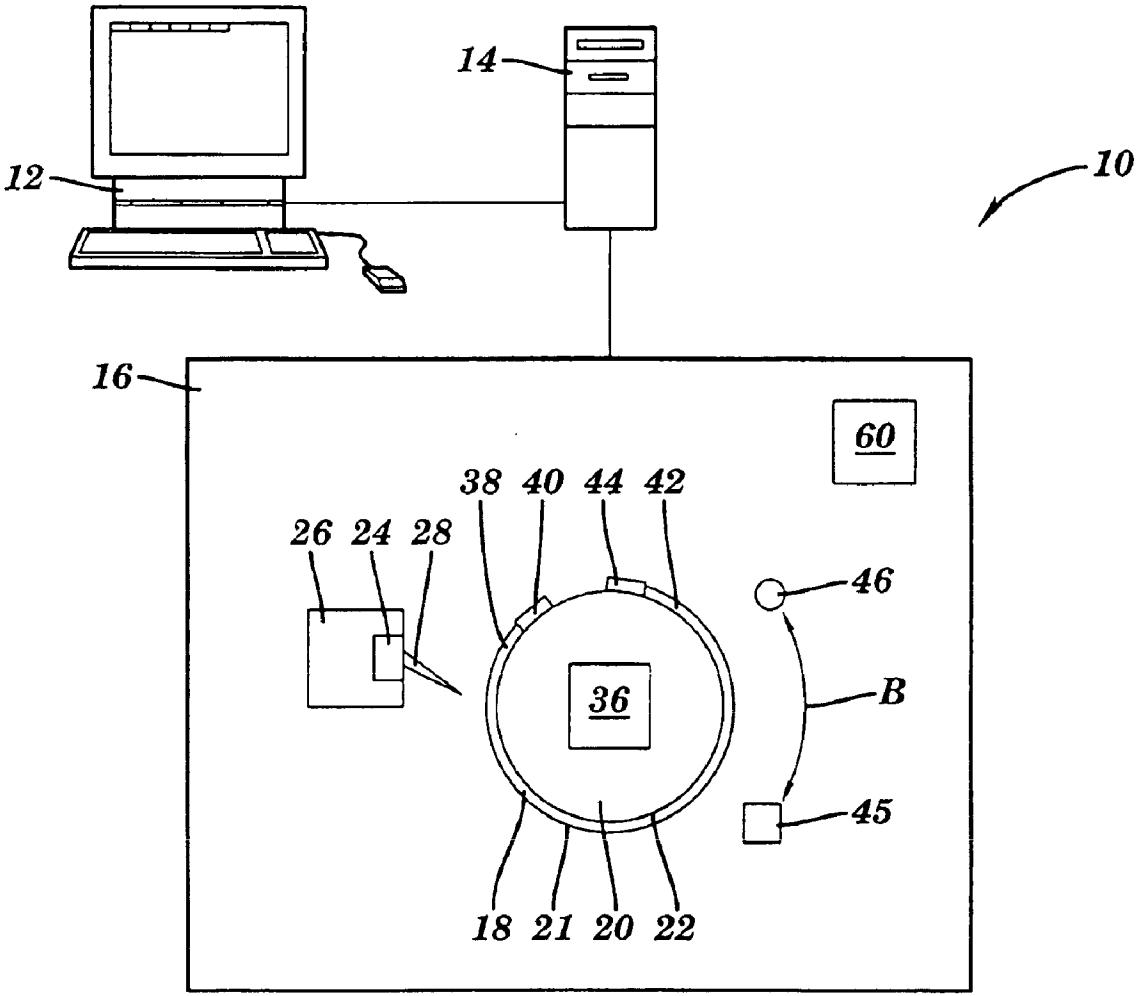
FIG. 1 illustrates an external drum imaging system for recording images onto a supply of recording media such as a printing plate.

The features of the present invention are illustrated in detail in the accompanying drawings, wherein like reference numerals refer to like elements throughout the drawings. Although the drawings are intended to illustrate the present invention, the drawings are not necessarily drawn to scale.

An example of an external drum imaging system 10 is illustrated in FIG. 1. In this example, the imaging system 10 comprises an external drum platesetter configured to record digital data onto a printing plate. Although described below with regard to an external drum platesetter, the printing plate supporting and feeding system of the present invention may be used in conjunction with a wide variety of other types of external drum, internal drum, or flatbed imaging systems, including imagesetters and the like, without departing from the intended scope of the present invention.

The imaging system 10 generally includes a front end computer or workstation 12 for the design, layout, editing, and/or processing of digital files representing pages to be printed, a raster image processor (RIP) 14 for further processing the digital pages to provide rasterized page data (e.g., rasterized digital files) for driving an image recorder, and an image recorder or engine, such as an external drum platesetter 16, for recording the rasterized digital files onto a printing plate or other recording media. The external drum platesetter 16 records the digital data (i.e., "job") provided by the RIP 14 onto a supply of photosensitive, radiation sensitive, thermally sensitive, or other type of suitable printing plate 18.

A plurality of printing plates 18 are supplied in a cassette to the external drum platesetter, and are individually fed from the cassette by an autoloading system 60 and mounted on an external drum 20. The autoloading system 60 may accept a cassette containing a plurality of the same size printing plates 18, and/or may accept a cassette containing a plurality of different size printing plates 18. In accordance with the present invention, the printing plates 18 are stacked within the cassette without the use of slip-sheets. The present invention, however, may be easily modified for use with a cassette containing printing plates separated by slip-sheets. In an alternate embodiment of the present invention, a plurality of printing plates 18 may be provided in a stack without the use of a cassette.

Figure 2:
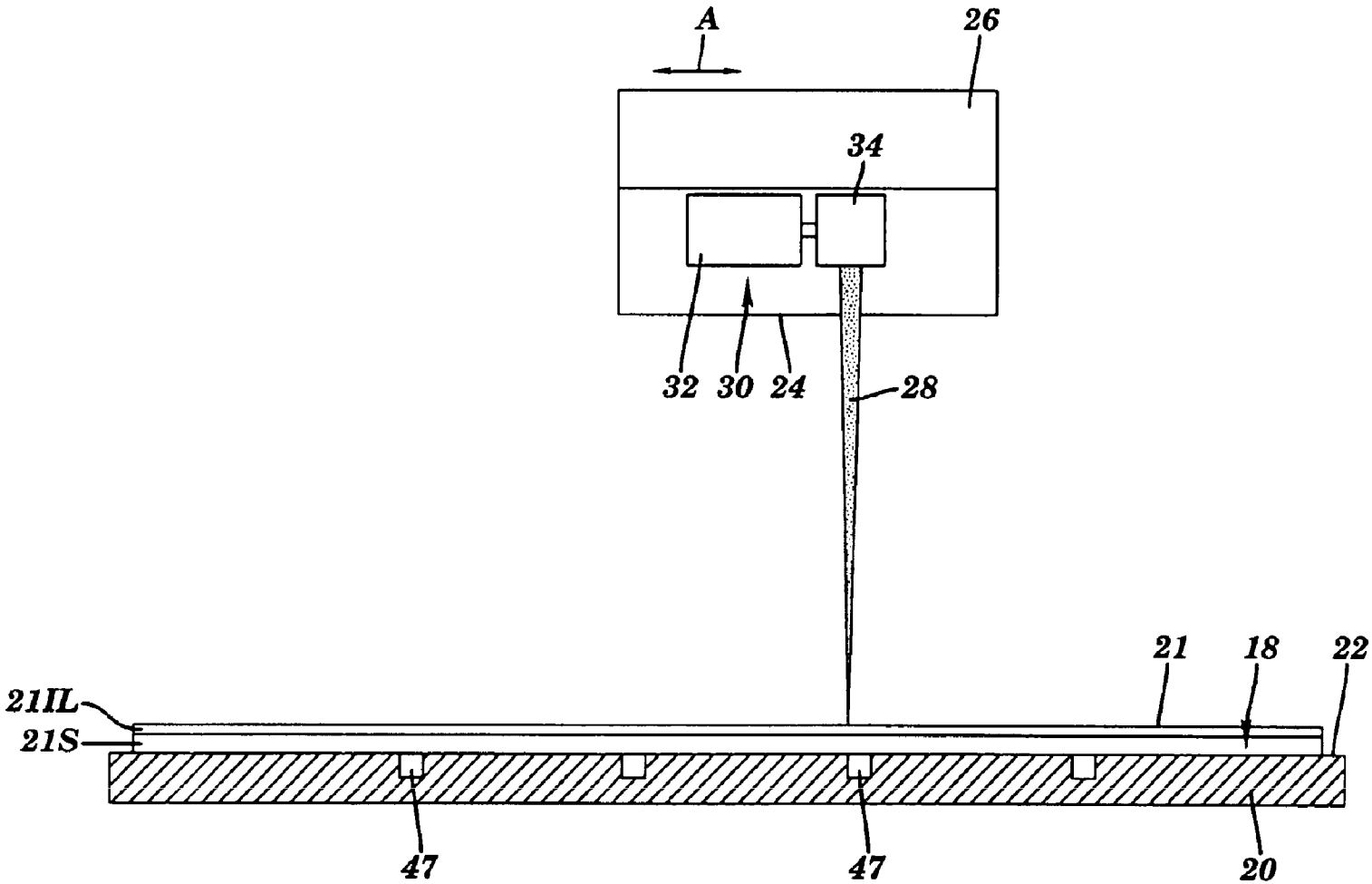
FIG. 2 illustrates an example of an imaging system including a movable optical carriage and scanning system, usable in the external drum imaging system of FIG. 1.

The external drum platesetter 16 includes an external drum 20 having a cylindrical media support surface 22 for supporting the printing plate 18 during imaging. The external drum platesetter 16 further includes a scanning system 24, coupled to a movable carriage 26, for recording digital data onto the imaging surface 21 of the printing plate 18 using a single or multiple imaging beams 28. An example of a scanning system 24 is illustrated in FIG. 2. In particular, the scanning system 24 is displaced by the movable carriage 26 in a slow scan axial direction (directional arrow A) along the length of the rotating external drum 20 to expose the printing plate 18 in a line-wise manner when a single beam is used or in a section-wise manner for multiple beams. Other types of imaging systems may also be used in the present invention. As shown in FIG. 2, the printing plate 18 includes a substrate 21S and an imageable layer 21IL formed on the substrate 21S.

The external drum 20 is rotated by a drive system 36 in a clockwise or counterclockwise direction as indicated by directional arrow B in FIG. 1. Typically, the drive system 36 rotates the external drum 20 at a rate of about 100–1000 rpm. As further illustrated in FIG. 2, the scanning system 24 typically includes a system 30 for generating the imaging beam or beams 28. The system 30 comprises a light or radiation source 32 for producing the imaging beam or beams 28 (illustrated for simplicity as a single beam), and an optical system 34 positioned between the radiation source 32 and the media support surface 22 for focusing the imaging beam or beams 28 onto the printing plate 18. It should be noted, however, that the system 30 described above is only one of many possible different types of scanning systems that may be used to record image data on the printing plate 18.

In the external drum imaging system 10 shown in FIG. 1, the leading edge 38 of the printing plate 18 is held in position against the media support surface 22 by a leading edge clamping mechanism 40. Similarly, the trailing edge 42 of the printing plate 18 is held in position against the media support surface 22 by a trailing edge clamping mechanism 44. Both the trailing edge clamping mechanism 44 and the leading edge clamping mechanism 40 provide a tangential friction force between the printing plate 18 and the external drum 20 sufficient to resist the tendency of the edges of the printing plate 18 to pull out of the clamping mechanisms 40, 44, at a high drum rotational speed. Other known systems for mounting the printing plate 18 onto the external drum 20 may also be used.

An ironing roller system 46 may be provided to flatten the printing plate 18 against the media support surface 22 of the external drum 20 as the external drum 20 rotates past the ironing roller 46 during the loading of the printing plate 18. Alternately, or in addition, a vacuum source 45 may be used to draw a vacuum through an arrangement of ports and vacuum grooves 47 (see, e.g., FIG. 2) formed in the media support surface 22 to hold the printing plate 18 against the media support surface 22. A registration system (not shown), comprising, for example, a set of registration pins or stops on the external drum 20, and a plate edge detection system (not shown), may be used to accurately and repeatably position and locate the printing plate 18 on the external drum 20.

Figure 3:
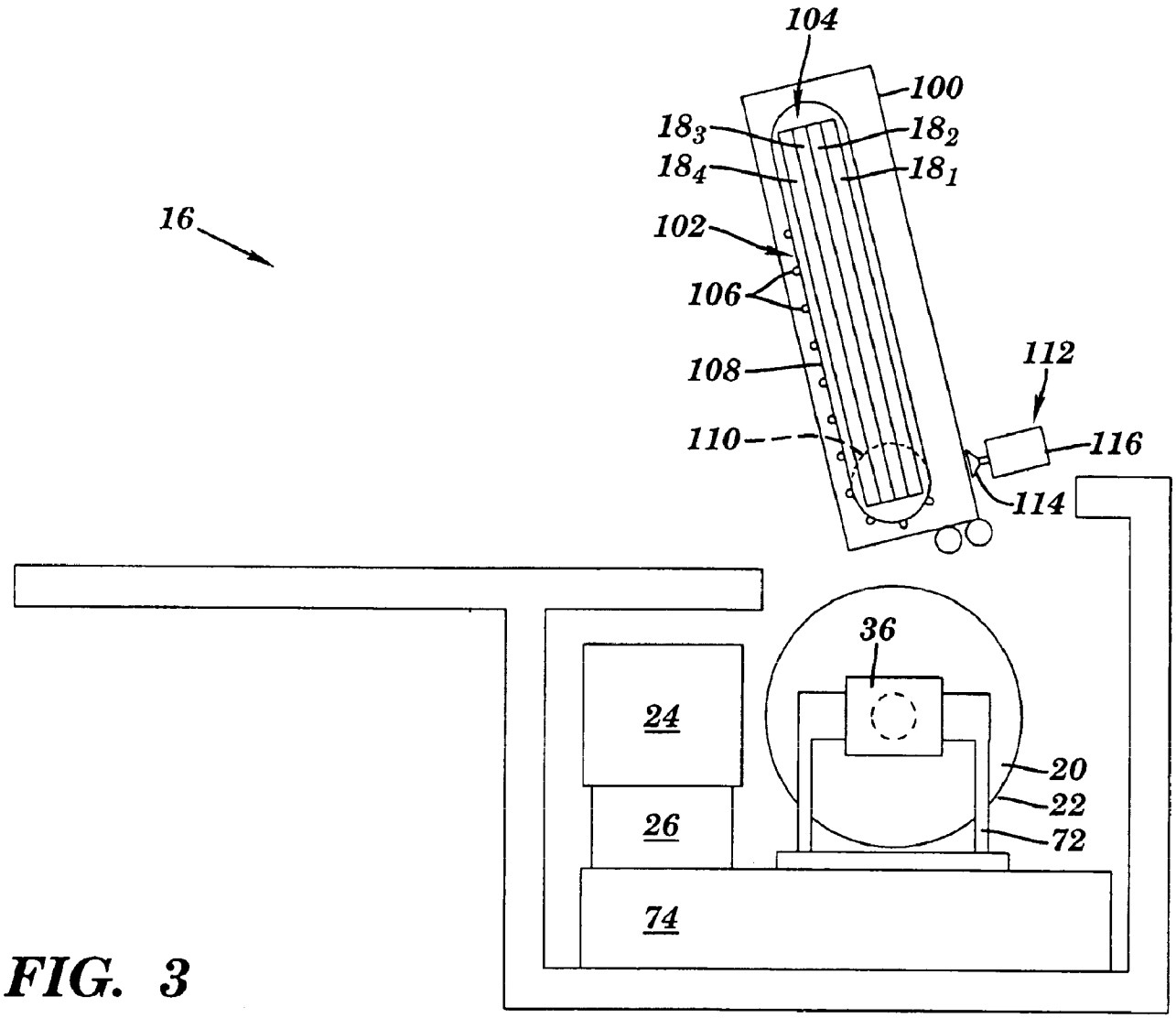
FIG. 3 is an end view of an external drum platesetter including a cassette having a printing plate supporting and feeding system in accordance with an embodiment of the present invention.

The basic structure of an external drum platesetter 16 including a cassette 100 having a printing plate supporting and feeding system 102 in accordance with the present invention is illustrated in FIG. 3. The external drum platesetter 16 includes an external drum 20 having a cylindrical media support surface 22 for supporting a printing plate 18 during imaging. The external drum 20 is supported by a frame 72. A drive system 36 rotates the external drum 20 during imaging. A scanning system 24, carried by a movable carriage 26, travels axially along the rotating external drum 20 to record digital data onto the imaging surface of the printing plate (see, e.g., FIG. 2). The external drum 20 and scanning system 24 are positioned on a base 74.

The cassette 100 contains a stack 104 of printing plates 18 (e.g., twenty-five printing plates). Only four printing plates $\mathbf{18}_1$, $\mathbf{18}_2$, $\mathbf{18}_3$, $\mathbf{18}_4$, are illustrated in FIG. 3 for clarity. In this embodiment of the invention, protective slip sheets are not present between the individual printing plates 18 of the stack 104. The printing plates 18 are manually loaded and stacked within the cassette 100, which is intended to be reusable. Alternately, the printing plates 18 may be automatically loaded into the cassette 100 using any suitable loading mechanism. The printing plates 18 are stacked with their emulsion side facing upward.

In accordance with the present invention, the printing plate supporting and feeding system 102 is located within the cassette 100, and generally comprises a plurality of plate feed beams 106 that are attached to, and extend between, a pair of endless, rotatable timing belts 108 (only one is shown in FIG. 3). The stack 104 of printing plates is located between the pair of timing belts 108. The plate feed beams 106 are configured to support large printing plates 18 without the need for a center support. The profile of each plate feed beam 106 is designed with a high stiffness to weight ratio such that, when supporting a printing plate 18 in the manner described below with regard to FIGS. 6 and 7, the plate feed beams 106 will not deflect and contact the underlying stack 104 of printing plates 18. In an alternate embodiment of the present invention, the stack 104 of printing plates 18, as well as the printing plate supporting and feeding system 102, are not enclosed within a cassette.

The timing belts 108 transfer the rotary motion of a drive system 110, such as an electric motor, to a linear motion of the plate feed beams 106. A guide roller (not shown) is positioned at the opposing side of each timing belt 108 to allow rotation of the timing belt. A controller (not shown) is used to accurately control the drive system 110 and resultant displacement of the timing belts 108 and plate feed beams 106 in a manner known in the art. As presented in greater detail below, the linear motion of the plate feed beams 106 operates to peel the top printing plate $\mathbf{18}_1$ off of the stack 104 of printing plates, allowing the top printing plate $\mathbf{18}_1$ to be subsequently loaded and mounted onto the exterior surface of the external drum 20.

A vacuum system 112 is used to pick up a bottom edge of the top printing plate $\mathbf{18}_1$ from the stack 104. The vacuum system 112 generally comprises a plurality of suction cups 114 (only one is shown) arranged parallel to the bottom edge of the printing plates in the stack 104, a system 116 for displacing the suction cups 114 toward and away from the top printing plate $\mathbf{18}_1$, and a vacuum source (not shown) for supplying a vacuum to the suction cups 114.

The operation of the printing plate supporting and feeding system 102 of FIG. 3 is illustrated in FIGS. 4–8.

Figure 4:
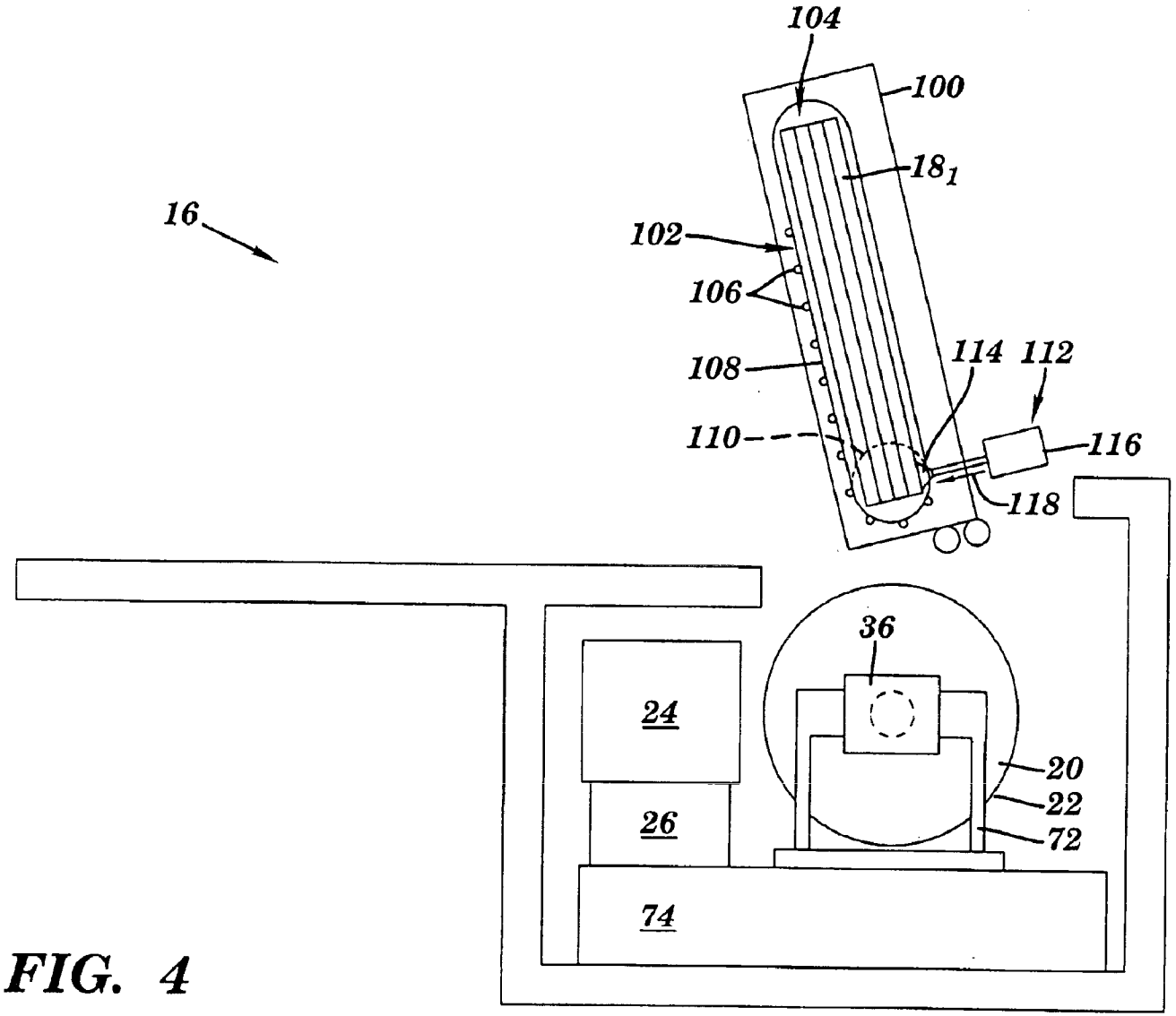
FIGS. 4–8 illustrate the operation of the printing plate supporting and feeding system of FIG. 3.

In FIG. 4, with the plate feed beams 106 in a "home" position within the cassette 100, the suction cups 114 are moved by the displacing system 116 into contact with a bottom edge of the top printing plate $\mathbf{18}_1$ on the stack 104 of printing plates. The suction cups 114 are moved in the direction indicated by directional arrow 118. A vacuum is applied to the suction cups 114 by the vacuum source, thereby securely coupling the bottom edge of the top printing plate $\mathbf{18}_1$ to the displacing system 116.

Figure 5:
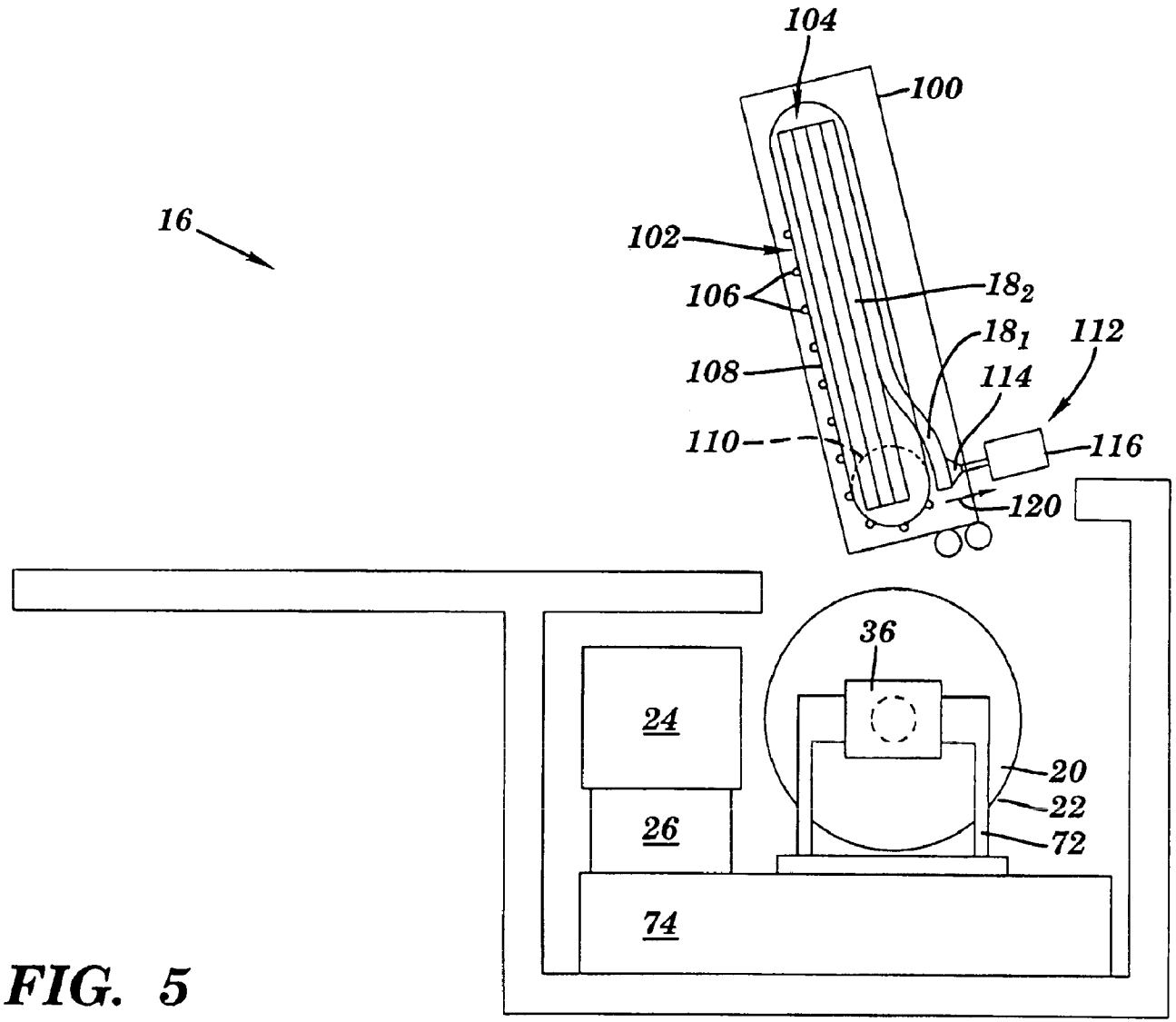

In FIG. 5, the bottom edge of the top printing plate $\mathbf{18}_1$ is peeled away from the stack 104 of printing plates as the displacing system 116 moves the suctions cups 114 in the direction indicated by directional arrow 120. The top printing plate $\mathbf{18}_1$ is displaced in direction 120 until the bottom edge of the top printing plate $\mathbf{18}_1$ is positioned outside the periphery of the timing belts 108. The bottom edge of the top printing plate $\mathbf{18}_1$ is held in this position by the displacing system 116.

Figure 6:
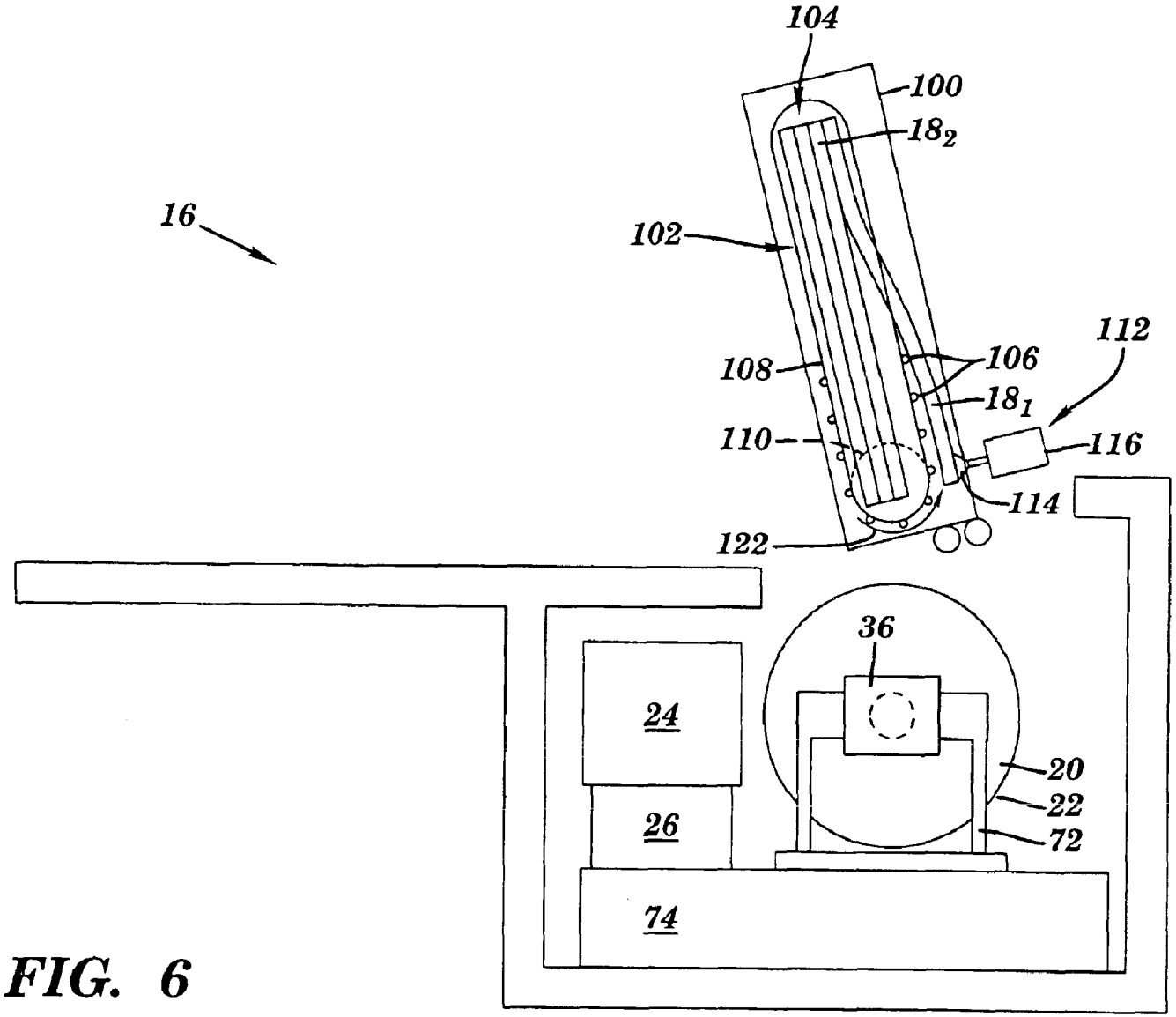
Figure 7:
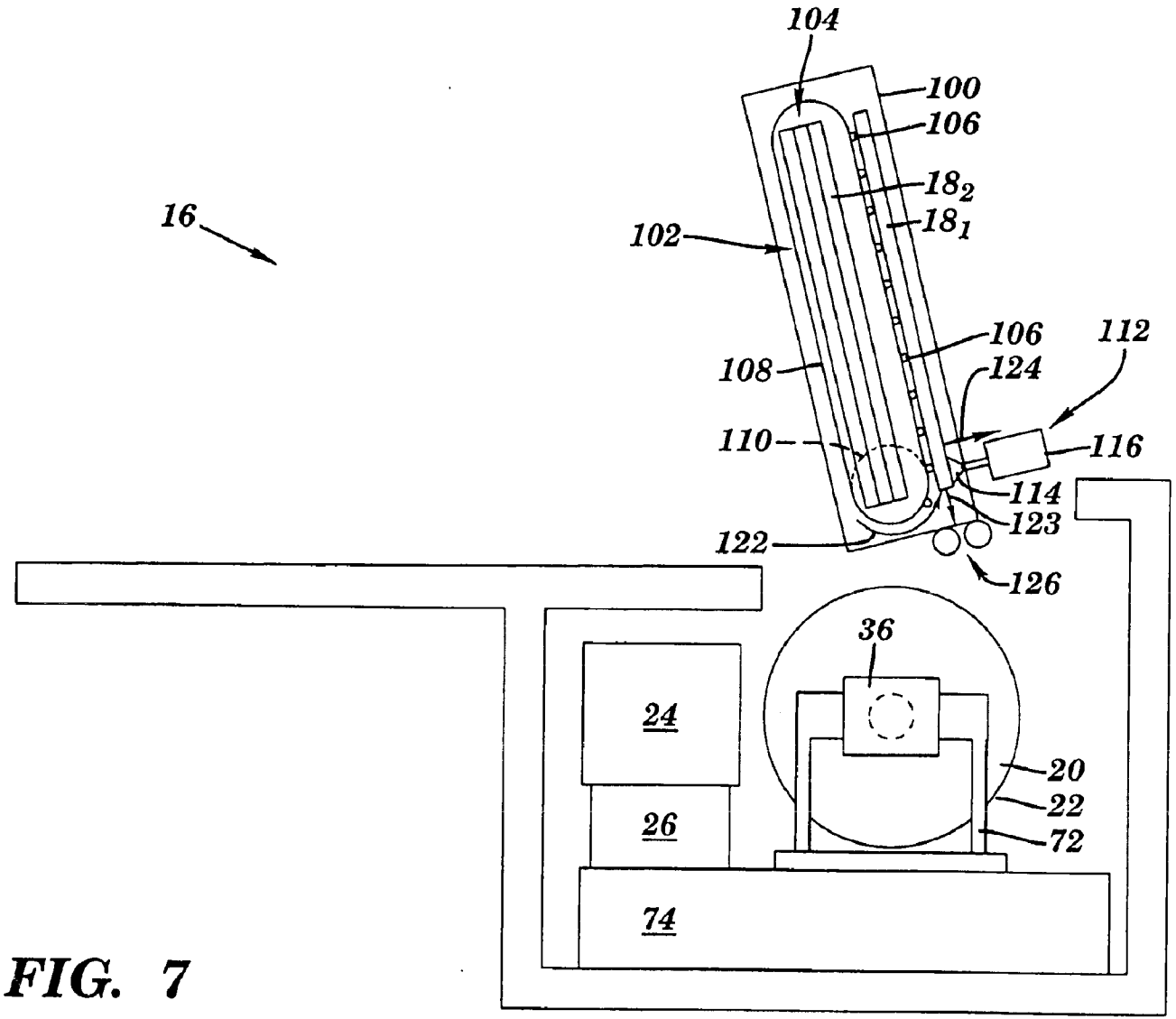
Figure 8:
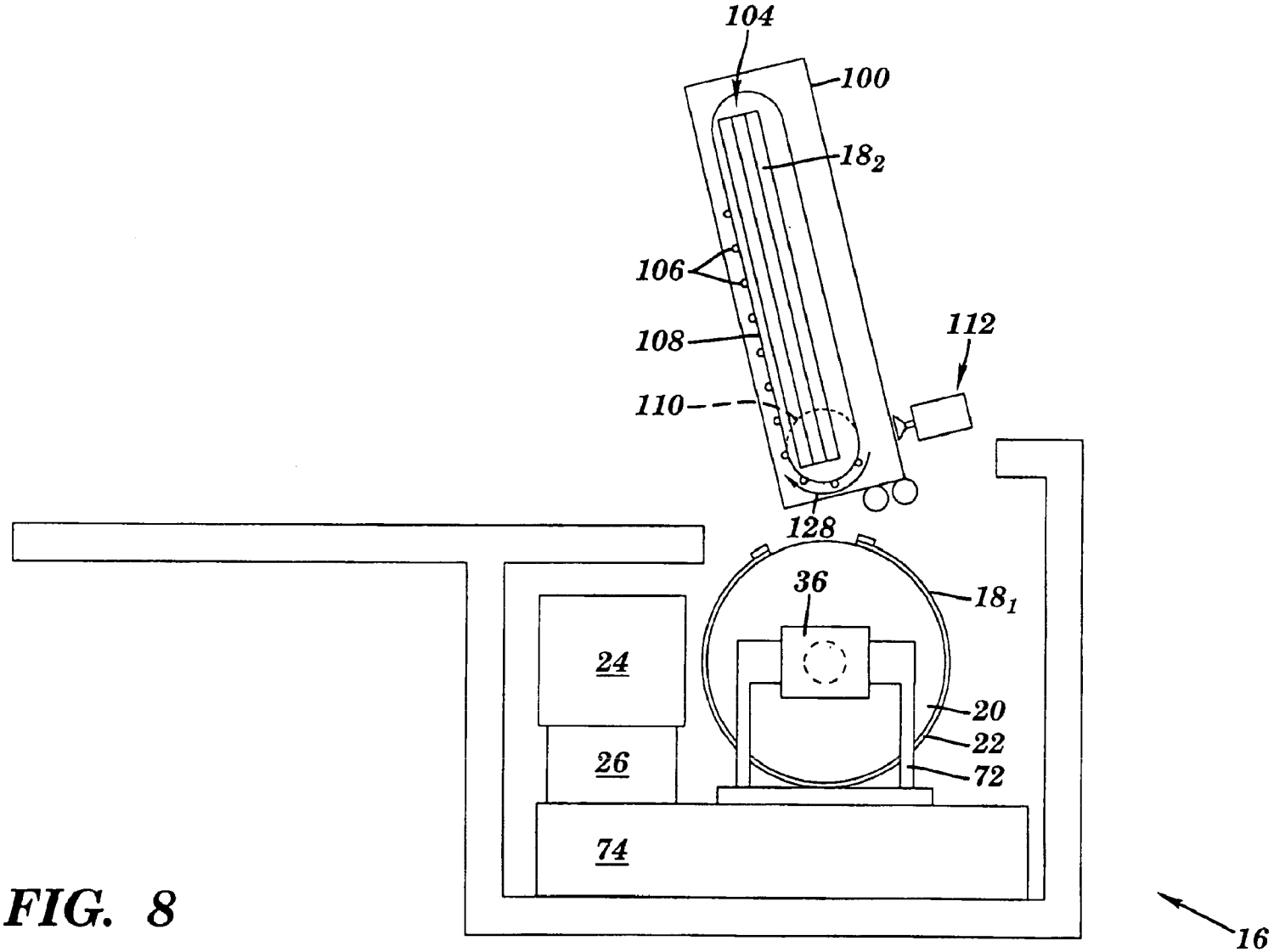

At this point in the operation of the printing plate supporting and feeding system 102 of the present invention, as illustrated in FIG. 6, the drive system 110 rotates the timing belts 108 in the direction indicated by directional arrow 122. This results in a corresponding displacement of the attached plate feed beams 106. As the leading plate feed beams 106 pass under the bottom edge of the top printing plate $\mathbf{18}_1$ that is coupled to, and held stationary by, the displacing system 116, the plate feed beams 106 engage and slide against the underside of the top printing plate $\mathbf{18}_1$, effectively peeling the top printing plate $\mathbf{18}_1$ away from, and partially off of, the next printing plated $\mathbf{18}_2$ of the stack 104. As shown in FIG. 7, rotation of the timing belts 108 continues in direction 122 until the top printing plate $\mathbf{18}_1$ is fully peeled off of the stack 104 and is supported by the plate feed beams 106. At this point, with the printing plate supporting and feeding system 102 in a "plate loaded" position within the cassette 100, the top printing plate $\mathbf{18}_1$ no longer contacts the next printing plate $\mathbf{18}_2$ of the stack 104. During the "peeling" operation, the plate feed beams 106 do not contact the top surface (i.e., the emulsion side) of the next printing plate $\mathbf{18}_2$ on the stack 104; the plate feed beams 106 only contact and slide against the underside of the top printing plate $\mathbf{18}_1$. This prevents the emulsion side of the next printing plate $\mathbf{18}_2$ from being damaged.

Upon the subsequent release of the vacuum supplied by the vacuum source to the suction cups 114, and the displacement of the suctions cups 114 by the displacing system 116 away from the top printing plate $\mathbf{18}_1$ in the direction indicated by directional arrow 124, the top printing plate $\mathbf{18}_1$ is moved downward as indicated by directional arrow 123 toward a pair of nip rollers 126. The top printing plate $\mathbf{18}_1$ may slide downward over the plate feed beams 106 toward the pair of nip rollers 126 due to the force of gravity, or may be mechanically displaced toward the pair of nip rollers 126 in any manner known in the art. Alternately, with the suction cups 114 still attached by vacuum to the top printing plate $\mathbf{18}_1$, the displacing system 116 (and attached top printing plate $\mathbf{18}_1$) may be shifted downward in direction 123 to position the edge of the top printing plate $\mathbf{18}_1$ at or within the nip rollers 126. Guide means may be provided within the cassette 100 to prevent the top printing plate $\mathbf{18}_1$ from bucking as it moves downward toward the pair of nip rollers 126.

The nip rollers 126, which may be formed as part of the cassette 100 or other suitable portion of the external drum platesetter 16, operate to direct the bottom (i.e., leading) edge of the top printing plate $\mathbf{18}_1$ to a plate mounting system (not shown) that is configured to mount the printing plate onto the external drum 20 of the external drum platesetter 16 for subsequent imaging. The top printing plate $\mathbf{18}_1$ is shown mounted to the external drum 20 in FIG. 8. Such a mounting system is disclosed in detail, for example, in U.S. Pat. No. 6,295,929, entitled "External Drum Imaging System," which is incorporated herein by reference.

After the printing plate $\mathbf{18}_1$ exits the cassette 100, the drive system 110 reverses the direction of rotation of the timing belts 108, thereby rotating the timing belts 108 in the direction indicated by directional arrow 128. The rotation of the timing belts 108, and the corresponding displacement of the plate feed beams 106, continues until the plate feed beams 106 are returned to their "home" position within the cassette 100. The next printing plate $\mathbf{18}_2$ in the stack 104, which now assumes the role of the "top" printing plate in the stack 104, can be fed from the cassette 100 to the external drum 20 by repeating the steps described above with regard to FIGS. 3–8.

Figure 9:
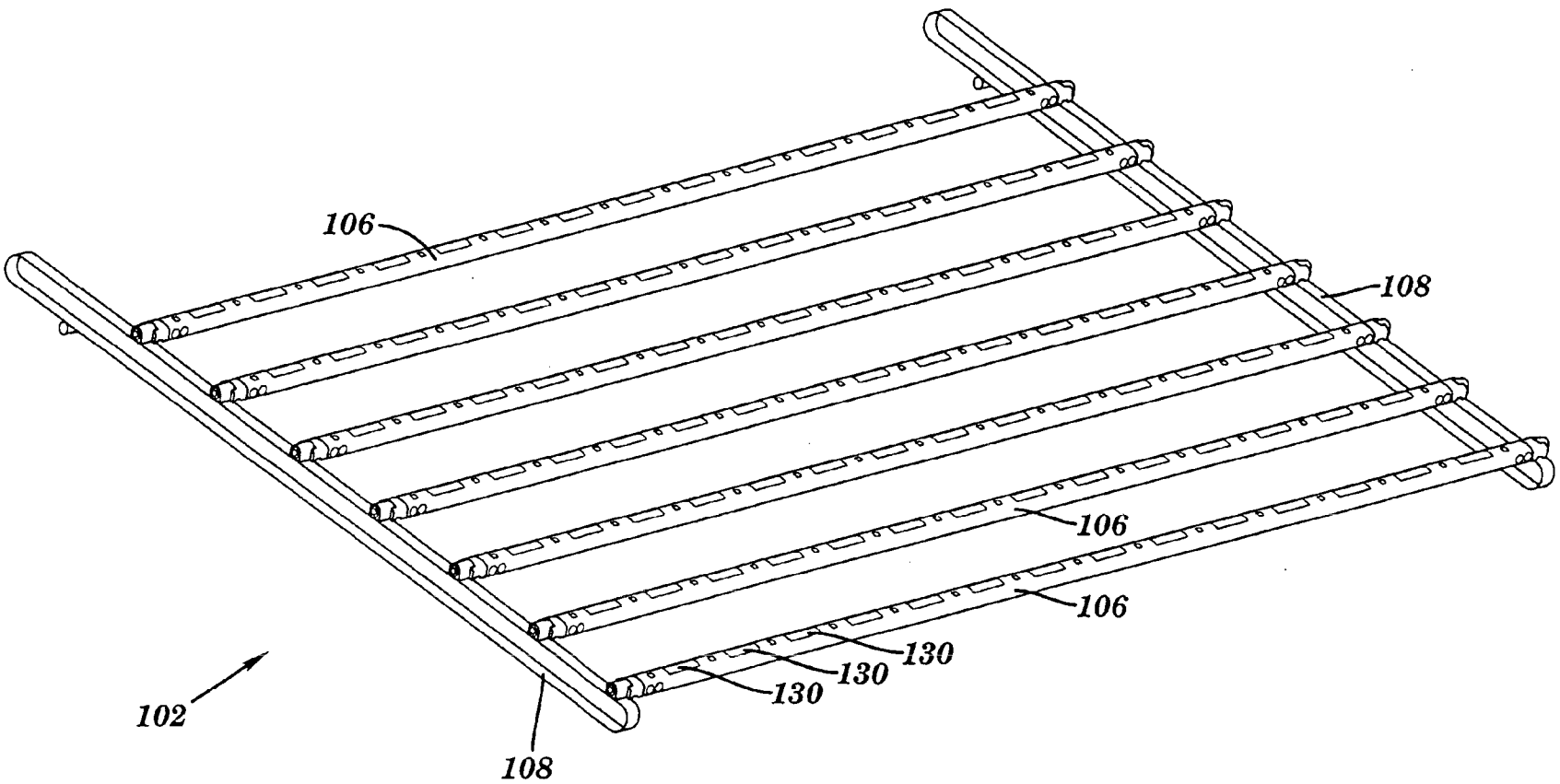
FIG. 9 illustrates the timing belts and attached plate feed beams of the printing plate supporting and feeding system of the present invention.

The printing plate supporting and feeding system 102 of the present invention is illustrated in greater detail in FIG. 9. As shown, the printing plate supporting and feeding system 102 comprises a pair of timing belts 108 and a plurality of plate feed beams 106 attached to, and extending between, the timing belts 108. Each plate feed beam 106 includes a series of rotatable rollers 130 that allow a printing plate 18 and the plate feed beam 106 to slide across each other with minimal resistance, thereby avoiding any scratching or other damage that could render the printing plate 18 unusable for printing.

Figure 11:
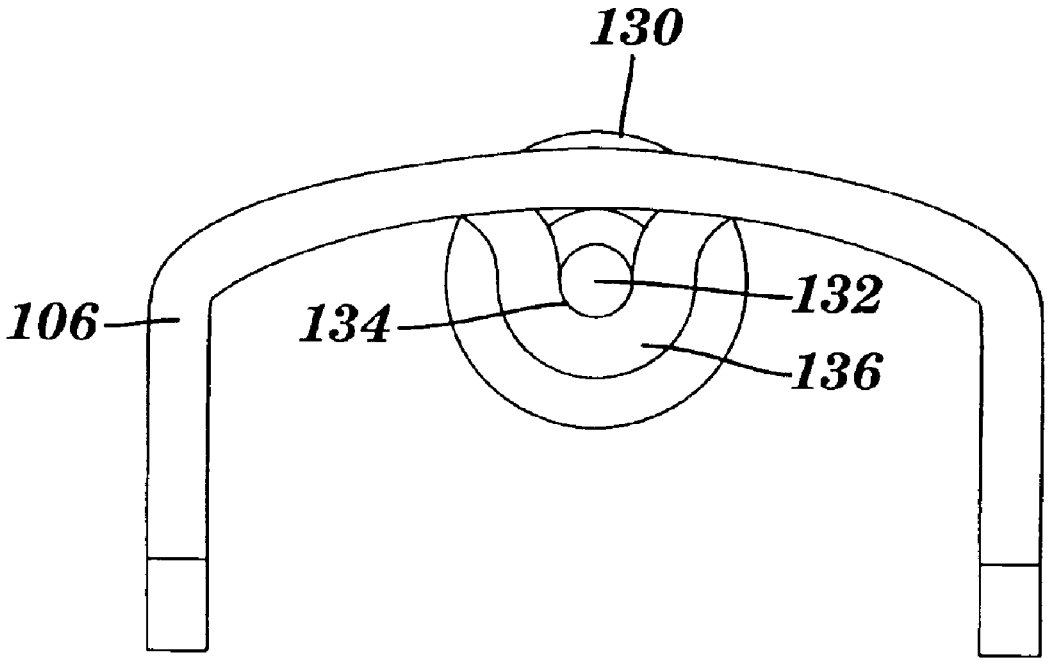
FIG. 11 is a cross-sectional view of the plate feed beam illustrated in FIG. 10.

As illustrated in FIG. 11, the axis of rotation 132 of each roller 130 is parallel to the longitudinal axis of its corresponding plate feed beam 106. Each roller 130 is attached to a shaft 134, and is free to rotate about the shaft 134. The shaft 134 is secured to the plate feed beam 106 by forms 136 that are crimped tight. Other techniques for securing the shaft 134 to the plate feed beam 106 may also be employed. A separate shaft 134 may be provided for each individual roller 130. Alternately, a single shaft 134, which extends along the length of the plate feed beam 106, may be used to rotatably attach all of the rollers 130 to the plate feed beam 106.

Figure 10:
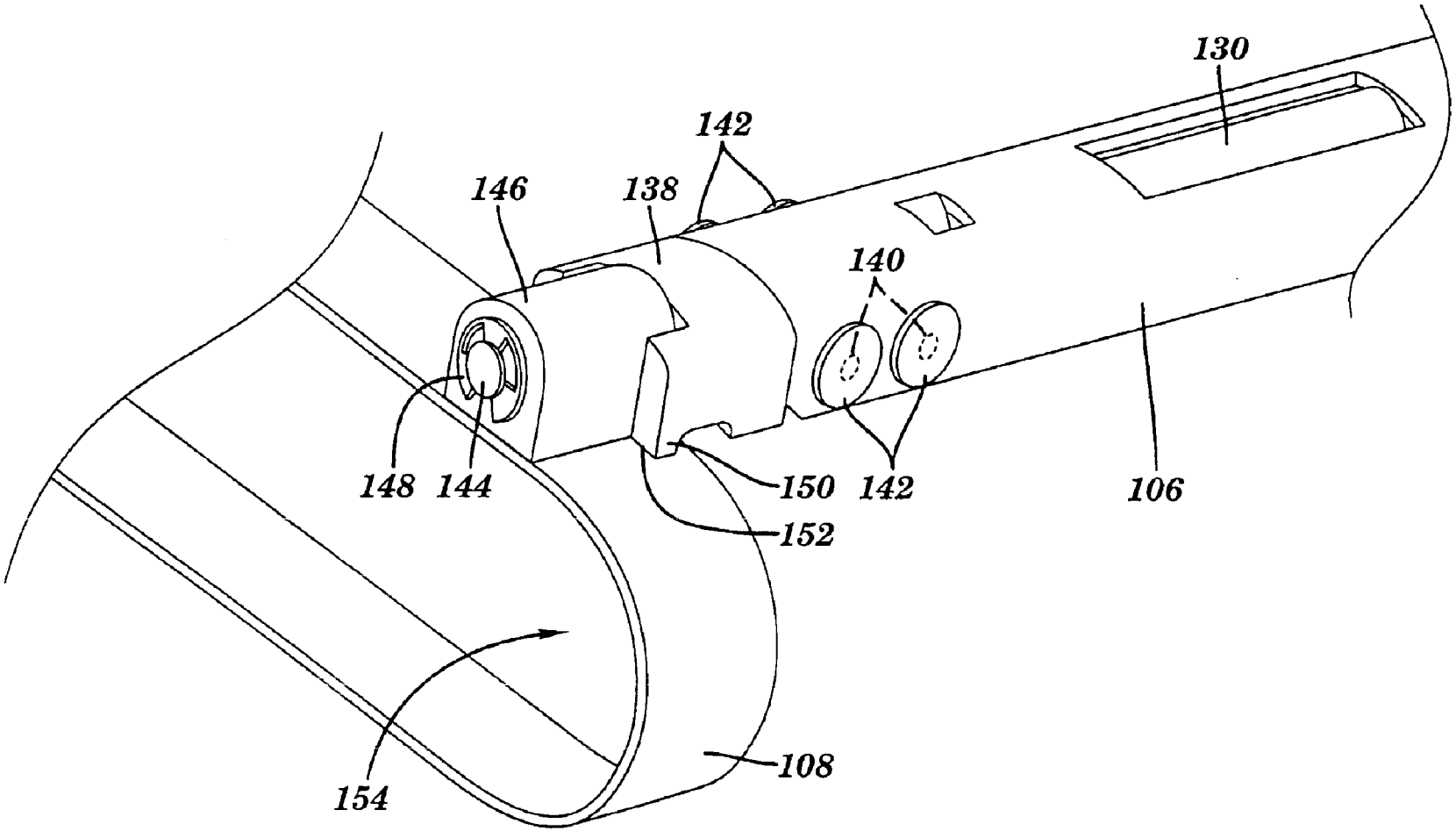
FIG. 10 is an enlarged view illustrating the connection of a plate feed beam to a timing belt, in accordance with the present invention.

As illustrated most clearly in FIG. 10, the ends of each plate feed beam 106 are attached to the outer surface of a timing belt 108 using an intermediate connector 138. The connector 138 includes a plurality of through holes 140 to which an end of a plate feed beam 106 is fastened with rivets 142 or other suitable fastening hardware. The connector 138 further includes a shaft 144 which extends through a coupler 146 that is permanently affixed to the timing belt 108. The shaft 144 is secured to the coupler 146 using a retaining ring 148, thereby preventing axial motion of the shaft 144 and plate feed beam 106 with respect to the timing belt 108, while allowing rotation about the axis of the shaft 144.

The intermediate connector 138 is provided with an anti-rotation device comprising a pair of protruding legs 150 that cradle opposing sides of the coupler 146 and extend partially over the timing belt 108. Each leg 150 includes a foot 152 having a profile that is configured to remain in contact with the outer surface of the timing belt 108. The profile of the foot 152 may be flat as shown, or may have any other configuration (e.g., rounded) capable of remaining in contact with the outer surface of the timing belt 108. The anti-rotation device ensures that the plate feed beam 106 always remains perpendicular to the tangent line of the timing belt 108. In addition, the anti-rotation device allows the plate feed beam 106 to be displaced around the outside of the end curve(s) 154 of the timing belt 108, and ensures that the rollers 130 on the plate feed beam 106 always remain in contact with the printing plate 18, thereby avoiding any possibility of plate scratching.

As illustrated in FIG. 11, each plate feed beam 106 has a profile that, when manufactured using a suitable material, provides a high stiffness to weight ratio that is capable of spanning large distances (e.g., 45") without significant deflection when supporting a large, often heavy, printing plate. In addition, the height profile of each plate feed beam 106 has been minimized to facilitate the use of the printing plate supporting and feeding system 102 of the present invention within an autoloading cassette. Each plate feed beam 106 may be formed in the profile shown in FIG. 11 using a material such as aluminum, steel, or plastic. Of course, other profile/material combinations resulting in the formation of plate feed beams having the above characteristics may also be used.

Figure 12:
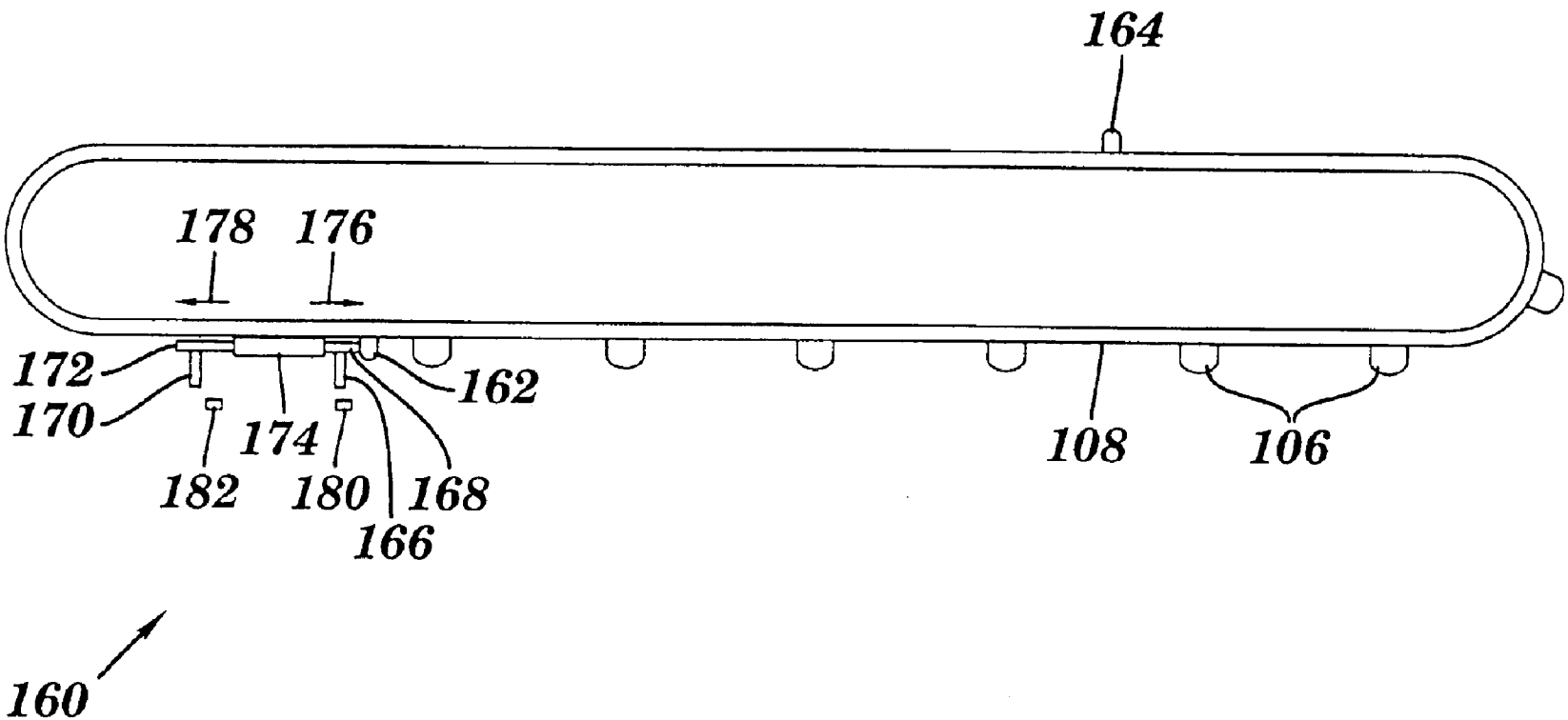
FIGS. 12–13 illustrate a sensing system for determining when the plate feed beams are located in their "home" or "plate loaded" positions.
Figure 13:
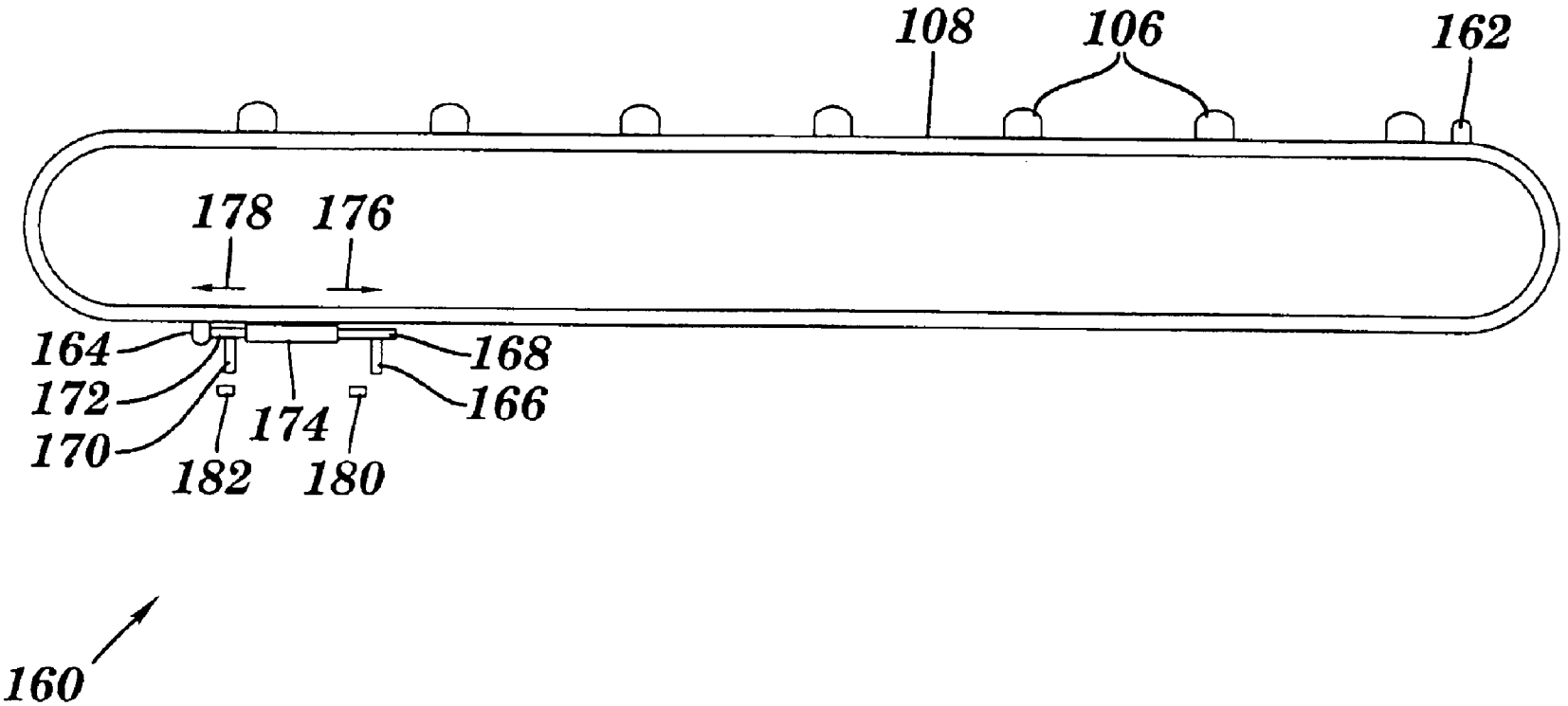
Figure 14:
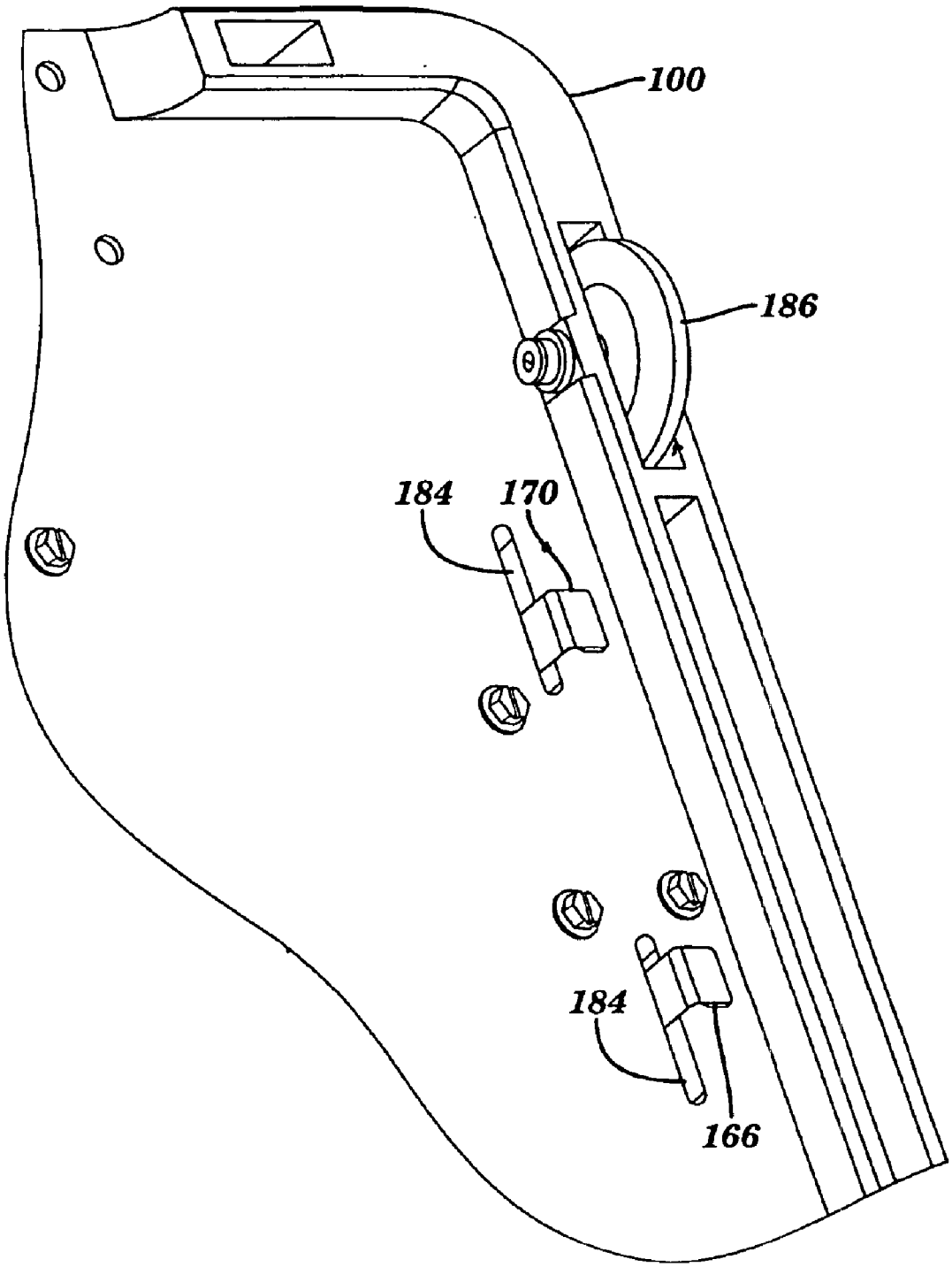
FIG. 14 illustrates the flags of the sensing system of protruding from an underside of a cassette.

A sensing system 160 for locating the "home" and "plate loaded" positions of the plate feed beams 106 is illustrated in FIGS. 12–14. One of the timing belts 108 is provided with a first boss 162 that actuates the sensing system 160 when the plate feed beams 106 are positioned in the "home" position (as depicted in FIG. 12), and a second boss 164 that actuates the sensing system 160 when the plate feed beams 106 are positioned in the "plate loaded" position (as depicted in FIG. 13). Each boss 162, 164, is permanently affixed to an outer surface of the timing belt 108. When actuated by the boss 162 or 164, the sensing system 160 generates a control signal indicating that the plate feed beams 106 have arrived, or are located at the "home" or "plate loaded" positions, respectively. The control signal is used to control, via a controller of a type known in the art (not shown), the operation of the drive system 110 (see, e.g., FIGS. 3–8) to stop and hold the plate feed beams 106 in the "home" or "plate loaded" position.

The sensor system 160 includes a flag 166 that is attached to a movable spring-loaded shaft 168, and a flag 170 that is attached to a movable spring-loaded shaft 172. Shafts 168 and 172 are biased outward in opposite directions, using a pair of springs located within housing 174, as indicated by directional arrows 176 and 178, respectively. The flags 168 and 170 may be configured to protrude through openings formed in the cassette 100 as illustrated in FIG. 14.

As shown in FIG. 12, boss 162 has engaged a first end of the shaft 168 in response to a displacement of the timing belt 108 in direction 178 toward the "home" position. Displacement of the timing belt 108 continues in direction 178 until the flag 166, which is attached to the shaft 168, passes over a sensor 180. The displacement of the timing belt 108 stops when the sensor 180 detects the flag 166. This occurs when the plate feed beams 106 reach their "home" position. Analogously, as shown in FIG. 13, boss 164 has engaged a first end of the shaft 172 in response to a displacement of the timing belt 108 in direction 176 toward the "plate loaded" position. Displacement of the timing belt 108 continues in direction 176 until the flag 170, which is attached to the shaft 172, passes over a sensor 182. The displacement of the timing belt 108 stops when the sensor 182 detects the flag 170. This occurs when the plate feed beams 106 reach their "plate loaded" position. The sensors 180 and 182 may comprise a reflection sensor of a type known in the art, or may be implemented using any technology capable of determining when a flag or other such indicator passes thereover.

The flags 166 and 170 may be configured to protrude through slots 184 formed in the cassette 100 as illustrated in FIG. 14. The sensors 180 and 182 would therefore be located externally from the cassette 100. This configuration may be used to prevent extraneous light from entering the cassette 100 when light sensitive printing plates are stacked therein. Alternately, the flags 166, 170, and sensors 180, 182, may all be located within the cassette 100. Also shown in FIG. 14 is one of a plurality of wheels 186 that may be mounted on the underside of the cassette 100 to facilitate the transporting of the cassette to and from the external drum platesetter 16, and/or to facilitate the placement and mounting of the cassette 100 on the external drum platesetter 16.

Figure 15:
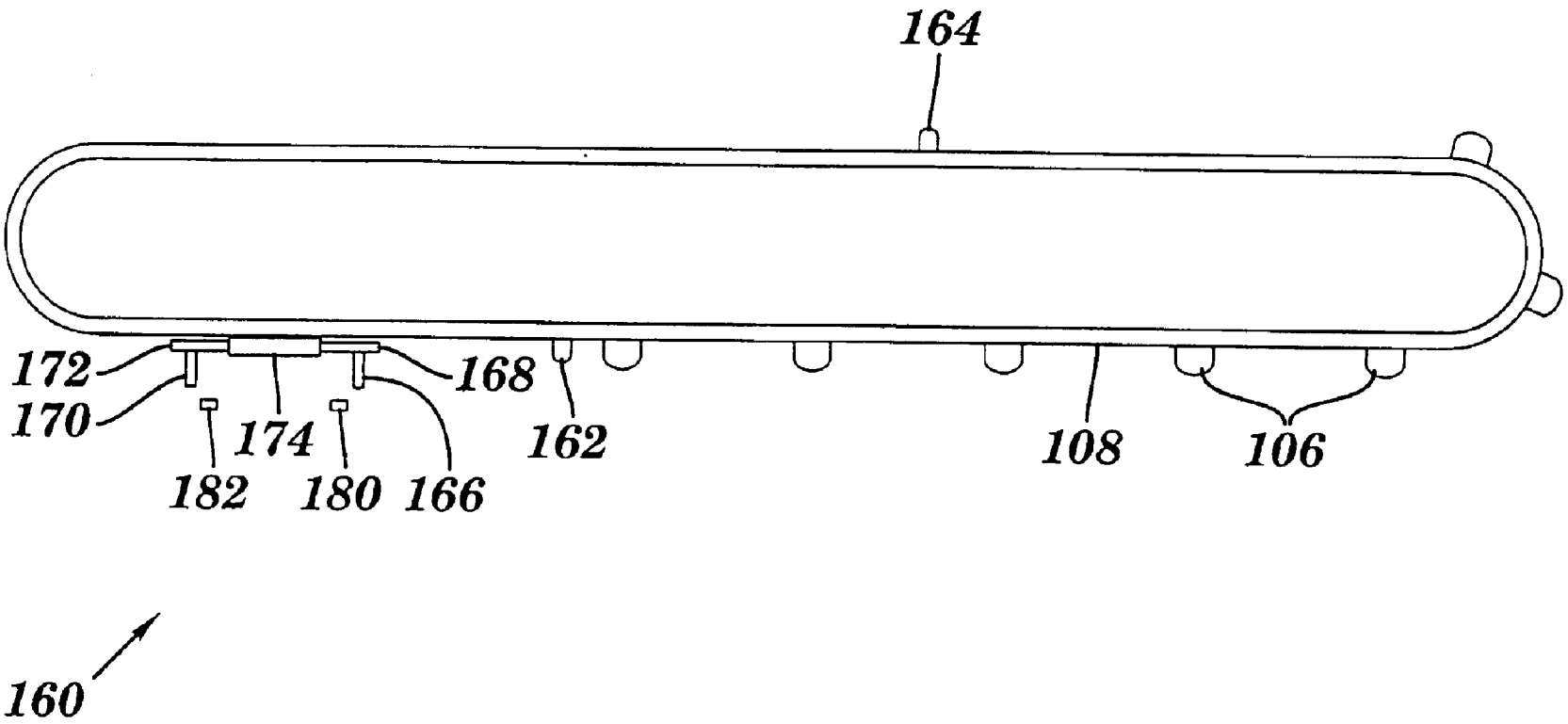
FIG. 15 illustrates the plate feed beams between their "home" and "plate loaded" positions.

When the plate feed beams 106 are located between their "home" and "plate loaded" positions, both of the spring-loaded shafts 168 and 172 extend fully out of the housing 174. An example of this "default" configuration of the sensor system 160, with both of the flags 166, 170 in an "off" position, is illustrated in FIG. 15.

Figure 16:
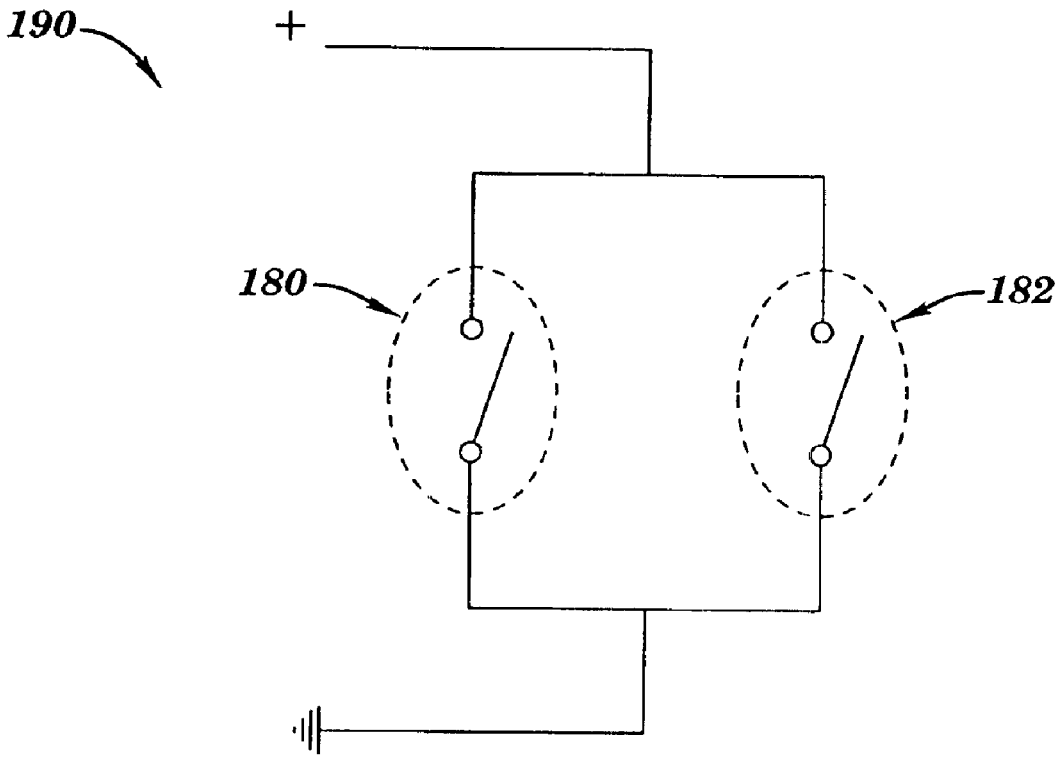
FIG. 16 is a circuit diagram of the sensing system.

In some cases it may be desirable to use a single sensor channel on a controller board to locate both the "home" and "plate loaded" positions of the plate feed beams 106. Such may be the case if there is a limited number of sensor channels available on the controller board. A single sensor channel can be used if the direction of rotation of the drive system 110 is known, and the two sensors 180, 182, are wired in parallel as shown in FIG. 16. When the sensors 180, 182, are wired in parallel, if either one of the sensors is turned "ON" (i.e., the sensor detects its corresponding flag 166, 170), the sensor channel 190 generates an "ON" signal.

Initially, neither of the sensors 180, 182, are "ON," and the sensor channel 190 generates an "OFF" signal. When the plate feed beams 106 are rotated in a known angular direction by the drive system 110, for example, in direction 178 (FIG. 12), the sensor channel 190 generate an "ON" signal when the plate feed beams 106 reach their "home" position. Subsequently, the plate feed beams 106 can be rotated in the opposite direction, for example, in direction 176 (FIG. 13), until the sensor channel 190 again generates an "ON" signal, thereby indicating that the plate feed beams 106 have reached their "plate loaded" position. In this manner, given a known direction of rotation, the position of the plate feed beams 106 can easily be determined.

The foregoing description of the present invention has been presented for purposes of illustration and description. It is not intended to be exhaustive or to limit the invention to the precise form disclosed, and many modifications and variations are possible in light of the above teaching. For example, more than two timing belts 106 may be used to support the plurality of plate feed beams 106. Such modifications and variations that may be apparent to a person skilled in the art are intended to be included within the scope of this invention.

We claim:

1. An apparatus, comprising:

a stack of unexposed printing plates;

a vacuum system for picking up an edge of a top printing plate from the stack of printing plates; and a peeling system including a pair of rotatable belts, wherein the stack of printing plates is located between the rotatable belts, a plurality of plate feed beams attached to, and extending between, the pair of rotatable belts, and a drive system for rotating the pair of rotatable belts to displace the plurality of plate feed beams between the top printing plate and an underlying printing plate in the stack of printing plates, thereby peeling the top printing plate from the stack of printing plates, wherein each plate feed beam includes at least one roller attached to a shaft coupled to the plate feed beam.

2. The apparatus of claim 1, wherein the roller is freely rotatable about the shaft.

3. The apparatus of claim 1, wherein each end of each plate feed beam includes an intermediate connector, and wherein the intermediate connectors are attached to corresponding couplers located on an outer surface of the rotatable belts.

4. The apparatus of claim 3, wherein each intermediate connector includes an anti-rotation device.

5. The apparatus of claim 4, wherein the anti-rotation devices are configured to maintain the plate feed beam perpendicular to a tangent line of the rotatable belts.

6. The apparatus of claim 4, wherein the anti-rotation devices are configured to maintain the plate feed beam rollers in contact with an underside of the top printing plate.

7. The apparatus of claim 4, wherein each anti-rotation device comprises a pair of protruding legs configured to cradle opposing sides of a corresponding coupler end extend partially over the outer surface of the rotatable belt on which the coupler is located.

8. The apparatus of claim 1, wherein the drive system displaces the plurality of plate feed beams between a "home" position, wherein none of the plate feed beams contact the top printing plate, and a "plate loaded" position, wherein the top printing plate is completely removed from the stack of printing plates by the plate feed beams.

9. The apparatus of claim 8, further comprising a sensor system for detecting when the plate feed beams ace in their "home" and "plate loaded" positions.

10. The apparatus of claim 9, wherein the sensor system comprises first and second shafts each including a flag, a first sensor for detecting the flag on the first shaft, and a second sensor for detecting the flag on the second shaft.

11. The apparatus of claim 10, wherein the first and second shafts are biased in opposite directions.

12. The apparatus of claim 11, wherein the first and second shafts are spring-loaded.

13. The apparatus of claim 10, wherein one of the rotatable belts includes a first boss and a second boss, wherein the first boss is configured to actuate the first shaft to displace its flag over the first sensor, thereby providing an indication that the plate teed beams are in their "home" position, and wherein the second boss is configured to actuate the second shaft to displace its flag over the second sensor, thereby providing an indication that the plate feed beams are in their "plate loaded" position.

14. The apparatus of claim 13, wherein the first boss and the second boss are located on an outer surface of the rotatable belt.

15. The apparatus of claim 13, wherein the first boss actuates the first shaft during a rotation of the rotatable belt by the drive system in a first direction, and wherein the second boss actuates the second shaft during a rotation of the rotatable belt by the drive system in a second, opposite direction.

16. The apparatus of claim 1, wherein the plate feed beams do not contact a surface of the underlying printing plate in the stack of printing plates.

17. The apparatus of claim 16, wherein the surface of the underlying printing plate comprises an emulsion.

18. The apparatus of claim 1, wherein each printing plate comprises:

a substrate; and an imageable layer formed on the substrate.

19. The apparatus of claim 18, wherein the imageable layer has characteristics selected from the group consisting of: photosensitive, radiation sensitive, and thermally sensitive.

20. The apparatus of claim 18, wherein the plate feed beams do not contact the imageable layer of the underlying printing plate in the stack of printing plates.

21. The apparatus of claim 1, wherein the rotatable belts comprises endless belts.

22. The apparatus of claim 1, wherein the stack of printing plates and the peeling system are located within a cassette.

23. The apparatus of claim 1, further comprising:

a media support surface;

a mounting system for mounting the top printing plate on the media support surface; and a scanning system for imaging data onto the top printing plate.

24. The apparatus of claim 23, wherein the media support surface comprises an external drum.

25. The apparatus of claim 24, further including a drive system for rotating the external drum during data imaging.

26. A method, comprising:

providing a stack of printing plates and a peeling system both enclosed within a cassette;

picking up an edge of a top printing plate from the stack of printing plates; and peeling the top printing plate from the stack of printing plates using a peeling system including a pair of rotatable belts, a plurality of plate teed beams attached to, and extending between, the pair of rotatable belts, and a drive system for rotating the pair of rotatable belts to displace the plurality of plate feed beams between the top printing plate and an underlying printing plate in the stack of printing plates.

27. The method of claim 26, further comprising:

providing each plate feed beam with et least one freely rotatable roller.

28. The method of claim 27, further comprising:

maintaining the plate feed beam rollers in contact with an underside of the top printing plate.

29. The method of claim 26, further comprising:

maintaining the plate feed beams perpendicular to a tangent line of the rotatable belts.

30. The method of claim 26, further comprising:

rotating the plurality of plate feed beams between a "home" position, wherein none of the plate feed beams contact the top printing plate, and a "plate loaded" position, wherein the top printing plate is completely removed from the stack of printing plates by the plate feed beams.

31. The method of claim 30, further comprising:

detecting when the plate feed beams are in their "home" and "plate loaded" positions.

32. The method of claim 26, further comprising:

preventing the plate feed beams from contacting a surface of the underlying printing plate in the stack of printing plates.

33. The method of claim 32, wherein the surface of the underlying printing plate comprises an imageable layer.

34. The method of claim 26, further comprising:

mounting the peeled top printing-plate on a media support surface; and imaging data onto the top printing plate.

35. The method of claim 34, further comprising:

rotating the media support surface during data imaging.

36. An apparatus, comprising:

a cassette containing a stack of unexposed printing plates and a peeling system, wherein the peeling system is configured to peel the top printing plate from an underlying printing plate of the stack of printing plates without contacting the underlying printing plate;

the peeling system including a pair of rotatable belts, wherein the stack of printing plates is located between the rotatable belts, a plurality of plate feed beams attached to, and extending between, the pair of rotatable belts, and a drive system for rotating the pair of rotatable belts to displace the plate feed beams between the top printing plate and the underlying printing plate in the stack of printing plates, thereby peeling the top printing plate from the stack of printing plates.

37. An apparatus, comprising:

a stack of printing plates;

a vacuum system for picking up an edge of a top printing plate from the stack of printing plates; and a peeling system including a pair of rotatable belts, a plurality of plate feed beams attached to, and extending between, the pair of rotatable belts, wherein each plate feed beam includes at least one freely rotatable roller attached to a shaft coupled to the plate feed beam, and a drive system for rotating the pair of rotatable belts to displace the plurality of plate feed beams between the top printing plate and an underlying printing plate in the stack of printing plates, thereby peeling the top printing plate from the stack of printing plates.

38. An apparatus, comprising:

a stack of printing plates;

a vacuum system for picking up an edge of a top printing plate from the stack of printing plates; and a peeling system including a pair of rotatable belts, a plurality of plate feed beams attached to, and extending between, the pair of rotatable belts, and a drive system for rotating the pair of rotatable belts to displace the plurality of plate feed beams between the top printing plate and an underlying printing plate in the stack of printing plates, thereby peeling the top printing plate from the stack of printing plates;

wherein each end of each plate feed beam includes an intermediate connector having an anti-rotation device, and wherein the intermediate connectors are attached to corresponding couplers located on an outer surface of the rotatable belts.

39. The apparatus of claim 38, wherein the anti-rotation devices are configured to maintain the plate feed beams perpendicular to a tangent line of the rotatable belts.

40. The apparatus of claim 38, wherein each plate feed beam includes at least one roller, and wherein the anti-rotation devices are configured to maintain the plate feed beam rollers in contact with an underside of the top printing plate.

41. The apparatus of claim 38, wherein each anti-rotation device comprises a pair of protruding logs configured to cradle opposing sides of a corresponding coupler and extend partially over the outer surface of the rotatable belt on which the coupler is located.

42. An apparatus, comprising:

a stack of printing plates;

a vacuum system for picking up an edge of a top printing plate from the stack of printing plates;

a peeling system including a pair of rotatable belts, a plurality of plate feed beams attached to, and extending between, the pair of rotatable belts, and a drive system for rotating the pair of rotatable belts to displace the plurality of plate feed beams between the top printing plate and an underlying printing plate in the stack of printing plates, thereby peeling the top printing plate from the stack of printing plates, wherein the drive system displaces the plurality of plate feed beams between a home position, wherein none of the plate feed beams contact the top printing plate, and a plate loaded position, wherein the top printing plate is completely removed from the stack of printing plates by the plate feed beams; and a sensor system for detecting when the plate feed beams are in their home and plate loaded positions;

wherein the sensor system comprises first and second shafts each including a flag, a first sensor for detecting the flag on the first shaft, and a second sensor for detecting the flag on the second shaft.

43. The apparatus of claim 42, wherein the first and second shafts are biased in opposite directions.

44. The apparatus of claim 43, wherein the first and second shafts are spring-loaded.

45. The apparatus of claim 42, wherein one of the rotatable belts includes a first boss and a second boss, wherein the first boss is configured to actuate the first shaft to displace its flag over the first sensor, thereby providing an indication that the plate feed beams are in their home position, and wherein the second boss is configured to actuate the second shaft to displace its flag over the second sensor, thereby providing an indication that the plate feed beams are in their plate loaded position.

46. The apparatus of claim 45, wherein the first boss and the second boss are located on an outer surface of the rotatable belt.

47. The apparatus of claim 45, wherein the first boss actuates the first shaft during a rotation of the rotatable belt by the drive system in a first direction, and wherein the second boss actuates the second shaft during a rotation of the rotatable belt by the drive system in a second, opposite direction.

* * * * *